United States Patent [19]

Dilley et al.

[11] Patent Number: 4,914,450

[45] Date of Patent: Apr. 3, 1990

[54] HIGH FREQUENCY WHIP ANTENNA

[75] Inventors: Douglas M. Dilley, La Mesa; Donald B. Forman, San Diego, both of Calif.

[73] Assignee: The United States of America as represented by the Secretary of the Navy, Washington, D.C.

[21] Appl. No.: 696,943

[22] Filed: Jan. 31, 1985

[51] Int. Cl.[4] ..... H01Q 1/22; H01Q 1/36

[52] U.S. Cl. ..... 343/895; 343/715; 343/900; 343/906; 439/916

[58] Field of Search ..... 343/714, 715, 895, 709, 343/900, 901, 903, 905, 906; 339/130 R, 130 C; 174/153 A, 138 A, 152 A; 439/916

[56] References Cited

U.S. PATENT DOCUMENTS

| | | | |
|---|---|---|---|
| 2,419,611 | 4/1947 | Walsh | 343/900 |
| 2,546,026 | 3/1951 | Coon | 343/900 |
| 2,763,003 | 9/1956 | Harris | 343/895 |
| 2,771,604 | 11/1956 | Goldstein | 343/749 |
| 3,102,268 | 8/1963 | Foley | 343/895 |
| 3,249,945 | 5/1966 | Lewis | 343/749 |
| 3,287,549 | 11/1966 | Lantery | 343/715 |
| 3,699,579 | 10/1972 | Miller | 343/897 |
| 3,774,221 | 11/1973 | Francis | 343/749 |
| 3,781,899 | 12/1973 | Lockwood | 343/895 |
| 3,852,757 | 12/1974 | Kaiser | 343/906 |
| 3,882,499 | 5/1975 | Garito | 343/904 |
| 3,950,757 | 4/1976 | Blass | 343/791 |
| 4,097,867 | 6/1978 | Eroncig | 343/715 |
| 4,161,737 | 7/1979 | Albright | 343/895 |
| 4,163,981 | 8/1979 | Wilson | 343/895 |
| 4,169,267 | 9/1979 | Wong | 343/895 |

FOREIGN PATENT DOCUMENTS

| | | | |
|---|---|---|---|
| 881758 | 11/1961 | United Kingdom | 343/900 |

*Primary Examiner*—Rolf Hille
*Assistant Examiner*—Michael C. Wimer
*Attorney, Agent, or Firm*—Harvey Fendelman; Thomas Glenn Keough

[57] ABSTRACT

A high frequency antenna that is particularly suitable for marine environments. The high frequency antenna has a metallic base flange, a metallic spring assembly for permitting flexibility and shock resistance and a metallic sleeve all maintained at ground potential so that the antenna is immune to being shorted out such as by salt water and preferably comprised of stainless steel. The radiating element of the antenna is formed on a fiberglass rod and is comprised of a flat, ribbon-like conductor or a plurality of wires approximating a ribbon like conductor. The radiating conductor is wound around the fiberglass rod such that the wound or wrapped areas have a width that is substantially equal to the non-wrapped areas on the rod to permit the ribbon-like conductor to radiate from both sides in order to achieve a low profile antenna.

23 Claims, 3 Drawing Sheets

HIGH FREQUENCY WHIP ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the fields of antennas and antenna mounting fixtures and, more particularly, to the fields of whip antennas for use on armored vehicles, particularly amphibious landing vehicles for the purpose of providing high frequency radio communications.

High frequency whip antennas now in use by the United States Marine Corps are prone to physical damage associated with motion. Vibration causes screw fittings to work loose and accelerations cause failures at antenna bases. Collisions with overhead obstructions especially at speeds above 25 miles per hour are known to cause failures of antenna elements. The encounter of heavy brush and tree limbs at speeds less than 5 miles per hour causes failure at antenna bases also.

High frequency whip antennas now in use were not designed for amphibious, marine environments. Mechanical connections tend to corrode when exposed to salt water spray. Base insulators short out when surf breaks over the top of amphibious vehicles. Salt water intrudes into antenna bases to short out or corrode electrical components.

High frequency whip antennas now in use are often too tall for use on high mobility vehicles. Although antenna height gives better electrical performance, increased height makes the antenna vulnerable to damage and the vehicle vulnerable to detection because of the increased visibility.

SUMMARY OF THE INVENTION

The present invention overcomes the foregoing enumerated problems with prior art whip antennas and mounting fixtures with a novel antenna and mounting fixture that are designed to resist short circuiting by salt water and with a novel antenna and mounting fixture that resist breakage due to accelerations and overhead obstructions. The present invention is a mobile whip antenna primarily intended for use on armored vehicles, particularly amphibious landing vehicles and serves the purpose of providing high frequency radio communications.

The present invention, in its preferred embodiment, comprises a 10-foot fiberglass whip antenna that is comprised of a mounting base assembly which has interior compartments filled with potting compound. The antenna and mounting assembly of the present invention are further comprised of a metal interface sleeve connecting the base spring assembly to the fiberglass whip section and having a spiral-wrapped ribbon-like conductor for radiating.

The present invention offers several advantages over existing whip antennas and mounting fixtures. Of primary importance, the present invention is shorter and less visible than existing high frequency mobile whip antennas. It is designed so that it can be completely sealed so as to be impervious to penetration by salt water. It is therefore immune to base insulator shorting and therefor avoids the problem of electrical shock hazard to personnel. The specific construction of the present invention prevents personnel riding in, on, or beside the vehicle to which it is mounted from being struck by the antenna when the vehicle, because of its motion over uneven terrain, is made to buck or corkscrew. The present invention provides a higher radiating efficiency than existing whip antennas of the same electrical height. The present invention features a spiral, multiwire or ribbon-like conductor used as the radiating element. This multiwire or ribbon-like conductor is designed such that its pitch, i.e. number of turns per unit length of supporting fiberglass rod, allows both sides of the ribbon-like conductor to be exposed to the radio universe. This effectively doubles the available radiating surface area of the radiating element as compared to a tightly wound helical radiator and thus reduces skin-effect losses.

Another feature of the present invention is that solid dielectric materials are utulized to fill voids within the structure. By this technique, RF potentials are not allowed to develop across air gaps thereby allowing higher power levels to be utilized with smaller antenna dimensions.

The whip antenna and mounting assembly of the present invention can be manufactured utilizing relatively unmodified fiberglass fishing pole manufacturing technology in its assembly. Consequently, the manufacturing costs involved in producing antennas in accordance with the present invention are substantially reduced.

OBJECTS OF THE INVENTION

Accordingly, it is the primary object of the present invention to disclose a novel whip antenna for providing high frequency radio communications that is particularly suitable for amphibious landing vehicles.

It is another object of the present invention to disclose a novel whip antenna and mounting assembly which has a coaxial base spring break-away which is maintained at ground potential and which is consequently immune to base insulator shorting.

It is another object of the present invention to disclose a whip antenna mounting base assembly that is capable of making a water-tight seal while at the same time making an excellent RF connection.

It is another object of the present invention to provide a whip antenna that minimizes the possibility of nearby personnel being struck by it when the vehicle upon which it is mounted traverses uneven terrain.

It is a concomitant object of the present invention to disclose an antenna that provides a higher radiating efficiency than prior art whip antennas of the same electrical height.

It is a still further object of the present invention to disclose a novel whip antenna radiating element comprised of a spiral multiwire or ribbon-like conductor which allows both sides of the conductor to be exposed to the radio universe.

It is another object of the present invention to disclose a novel whip antenna and mounting assembly that can be manufactured utilizing existing technology at a relatively low cost.

Other objects, advantages and novel features of the invention will become apparent from the following detailed description of the invention when considered in conjunction with the accompanying drawings.

DESCRIPTION OF THE PREFERRED EMBODIMENT

Figure 1:
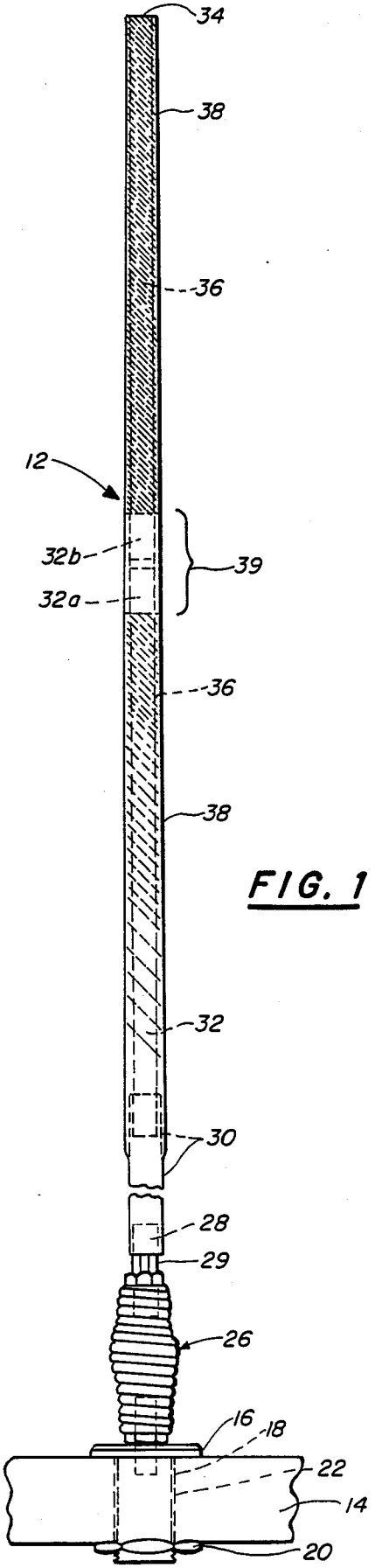
FIG. 1 is a side view of the whip antenna and mounting assembly of the present invention.

Referring first to FIG. 1 the high frequency whip antenna and mounting assembly of the present invention will be described in general terms. The high frequency whip antenna mounting assembly 12 of the present invention is illustrated in FIG. 1 as being secured to a mounting surface 14 which may, for instance, be the mounting platform of an armored amphibious vehicle. It should be understood, however, that the antenna and mounting assembly of the present invention may be utilized in a multitude of other environments and mounted on other surfaces depending upon the particular utilization required or desired. The antenna and mounting assembly 12 are secured to the mounting surface 14 by means of base flange member 16 which has male threaded portions 18 and locking hexagonal nut 20 which attaches to threaded portion 18 on the underside of mounting surface 14. The mounting surface 14 is provided with circular opening or clearance hole 22 for receiving the threaded portion 18 of the base flange 16. Base flange 16 and locking nut 20 are preferably made of stainless steel. A locking washer (not shown) may be used between nut 16 and surface 14. Also, a water sealing conductive gasket (not shown) may be used between flange 16 and the top of surface 14 to ensure a watertight seal.

The antenna and mounting assembly 12 further include a base spring assembly 26, preferably comprised of stainless steel, that is secured to the base flange member 16 in a manner to be described in greater detail below. Extending from the upper portion of the base spring assembly 26 is an upper nipple 28 having a male threaded exterior portion for engagement with cooperating female threads at the interior upper portion of the base spring assembly 26. The nipple 28 is secured in position by means of hex nut 29. The nipple 28 is coupled at its upper end to metallic sleeve 30. Nipple 28, hex nut 29 and metallic sleeve 30 are preferably comprised of stainless steel.

Metallic sleeve 30 holds the bottom end of fiberglass rod 32 illustrated in dotted lines in FIG. 1. The fiberglass rod 32 extends to the top end or tip 34 of the antenna 12 and serves as the support structure for the radiating elements 36 which are wrapped around the fiberglass rod 32. It is noted that the depiction of radiating elements 36 in FIG. 1 is not to scale and is not intended to be an accurate representation of the location and positioning of the radiating elements 36. The particular winding or wrapping technique utilized and the particular placement of the radiating elements 36 will be described in detail below. FIG. 1 is intended to illustrate only that the radiating element 36 are spiral wrapped conductors, the details of the wrapping being illustrated below. Fiberglass jacket 38 covers the radiating elements 36 and provides weatherproofing and damage protection to the antenna structure. Coupling section 39 to be described in greater detail below is a metallic, preferably brass, coupling that serves to join both the upper and lower portions of fiberglass rod 32.

Figure 2:
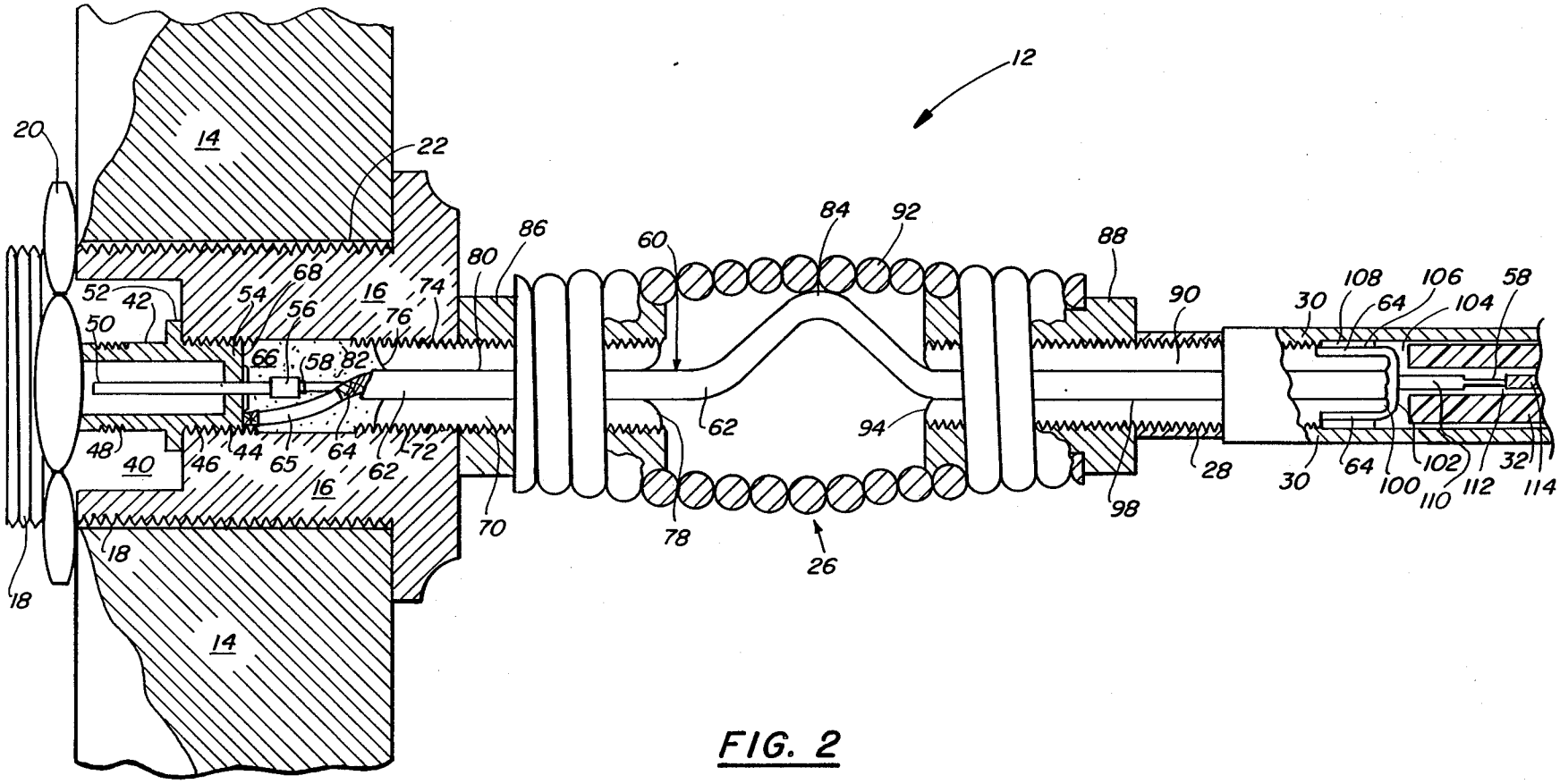
FIG. 2 is a partially cut away, partial cross sectional side view of the base mounting assembly of the present invention.

Referring now to FIG. 2 the details of the threaded base flange 16, the base spring assembly 26 and a portion of the metallic sleeve assembly 30 will now be described. As seen in FIG. 2 the threaded base flange 16 has a cup-shaped interior cavity 40. A radio frequency (RF) connector 42 such as a model UG-680/U or a UG-58A/u connector is coupled to the base flange member 16 within the interior cavity 40 by mating engagement of exterior male threads 44 on the RF connector 42 with interior female threads 46 on the base flange 16 or by bolting on (not shown). The RF connector 42 also has exterior male threaded portions 48 for engagement with the coupling fitting of a coaxial connector. Inner coaxial conductor 50 is an integral part of the RF connector 42 and extends from the vicinity of the threaded portions 48 through the connector 42 past base flange member 52 and out the top end 54 where it is connected via solder cup 56 to the inner conductor 58 of coaxial cable 60. As can be seen in FIG. 2, the insulator 62 on coaxial cable 60 is stripped away such that the outer braided conductor 64 is partially exposed in the area within cavity 66 of the base flange 16. The outer braided conductor 64 is electrically connected by means of soldering to the exterior metallic housing 68 of the RF connector 42. Insulative coating or spaghetti tubing 65 is used to cover a portion of braided conductor 64 within cavity 66.

A lower nipple 70, preferably made of stainless steel, has male threaded portions 72 which provide for mating engagement with female threaded portions 74 at the top end of base flange member 16. The lower nipple 70 has beveled ends 76 and 78 to avoid puncturing the insulator 62 around coaxial cable 60. Coaxial cable 60 extends through the inner passageway 80 of the threaded lower nipple 70. It is noted at this point that interior cavity 66 formed within the base flange member 16 is filled with potting compound 82 such as polyurethane, polystyrene, polyethylene or any other suitable potting compound. This ensures a watertight seal within the cavity 66 of the components contained therein.

As can be seen in FIG. 2, the coaxial cable 60 contains a loop 84 which is formed in order to accommodate movement and bending of the whip antenna 12 around the area of the base spring assembly 26. The base spring assembly 26 includes a lower flange member 86 which is in threaded engagement with the upper end of lower nipple 70. The base spring assembly 26 also includes an upper flange member 88 which is in threaded engagement with upper nipple 28 as is illustrated. Further, the base spring assembly 26 includes exterior spring component 92 which is formed around the lower flange member 86 and upper flange member 88 of the base spring assembly 26.

Upper nipple 28 has beveled lower end 94 provided in order to prevent puncturing of the insulator 62 of the coaxial cable 60. Surrounding a portion of the upper end of the upper nipple 28 is metallic sleeve member 30 which is in threaded mating engagement with the upper nipple 28 upper end as is illustrated in FIG. 2. As can be seen in FIG. 2, the coaxial cable 60 extends through the interior passageway 98 within the upper nipple 28 and is brought out through the opening in the open end of upper nipple 28. As illustrated in FIG. 2, upper nipple 28 includes a reduced diameter end 100 with beveled ends 102. The reduced diameter end 100 of upper nipple 28 is sufficiently small to be contained within the interior passageway 104 of sleeve member 30. As can also be seen in FIG. 2, the outer metallic, braided conductor 64 of coaxial cable 60 is brought around the exterior portion of reduced diameter end 100 and may be soldered to the exterior portion of reduced diameter end 100 such that it is in electrical contact with the upper nipple 28 and metallic sleeve 30. This braided conductor 64 is held in place by PVC sleeve 106 that surrounds the braided conductor 64 in the vicinity of the reduced diameter end 100 of upper nipple 28. The PVC sleeve 106 is crimped in place by ferrule 108.

As also is illustrated in FIG. 2, the insulator 110 around inner conductor 58 and inner conductor 58 are brought out through the top end of reduced diameter end 100 of the upper nipple 28. Also, the fiberglass rod 32 is contained within the interior passageway 104 of the metallic sleeve 30. The fiberglass rod 32 has a hollowed out core section 112 and the insulator 110 and inner conductor 58 of coaxial cable 60 are extended into this hollowed out core 112. As is also illustrated in FIG. 2, the coaxial cable 60 inner conductor 58 is electrically connected by soldering to standard copper wire 114.

Figure 3:
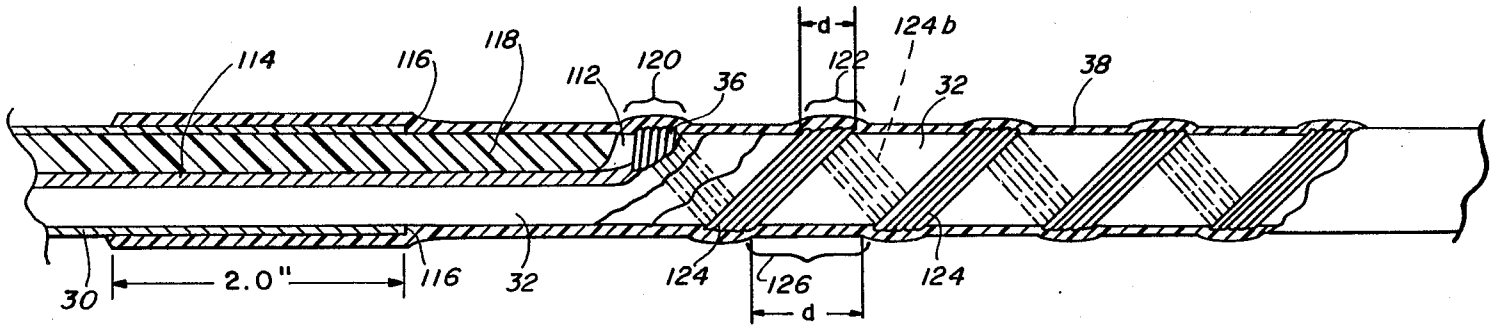
FIG. 3 is a partially cut away, partial cross sectional side view of the sleeve interface assembly of the present invention and including a partially cut away side view illustration of a portion of the fiberglass whip and radiating element winding pattern of the present invention.

Referring now to FIG. 3 it can be seen that the hollowed out core 112 of fiberglass rod 32 extends beyond the upper end 116 of sleeve 30 and is brought out to the surface of fiberglass rod 32. It can also be seen that the stranded copper wire 114 extends through the hollowed out core 112 and is also brought out to the surface of fiberglass rod 32. The stranded copper wire is held in place by retaining key 118, is preferably made of fiberglass or phenolic sheet and is cemented in place with epoxy cement.

At the area 120 where the hollowed out core 112 is brought to the surface and where the stranded wire 114 is also brought to the surface of the fiberglass rod 32, the stranded copper wire 114 is attached to the radiating element 36 as by soldering. The radiating element 36 is then helically wound around the fiberglass rod 32 from the area 120 to the tip 34 of the fiberglass rod in a manner to be described more particularly below.

Figure 6:
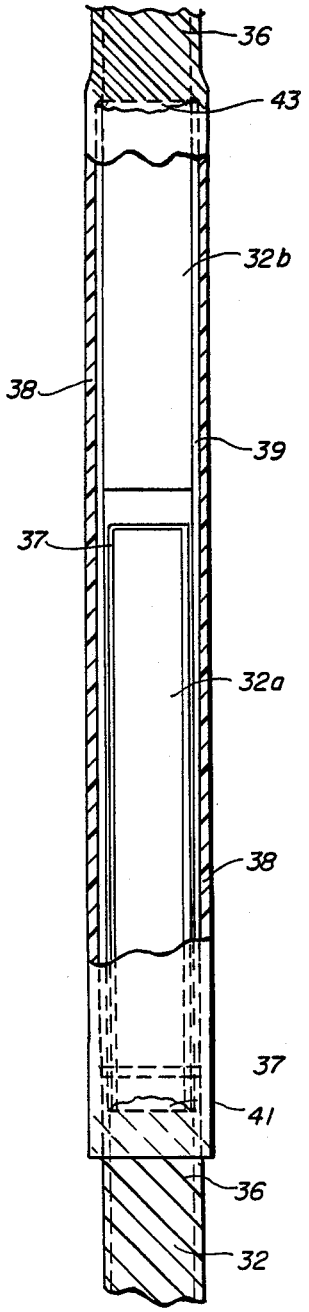
FIG. 6 is a partial cross-section, partial cut away side view of the coupling section of the present invention.

Referring now to FIG. 6, the coupling section 39 of the present invention will be described. Fiberglass rod 32 is split and the bottom portion **32*a* is capped with brass ferrule cap 37. Brass cylindrical sleeve 39 is glued to fiberglass rod upper portion 32*b* and contains fiberglass rod upper portion 32*b*. Brass sleeve 39 extends over and is secured to ferrule 37. The radiating conductors 36 are then soldered at solder joint 41 to brass ferrule cap 37 at the fiberglass rod lower portion 32*a* as illustrated. Similarly, the radiating conductors 36 are soldered at solder joint 43 to brass sleeve 39 at the fiberglass rod upper end 32*b* as illustrated. Thus electrical continuity is maintained by coupling section 39 between the radiators 36 on the fiberglass rod lower portion 32*a* and the radiators 36 on the fiberglass rod upper portion 32*b***.

The windig pattern of the radiating element 36 of the antenna 12 will now be described. Referring to FIG. 3, the winding pattern is begun by utilizing, in the preferred embodiment, either ten No. 26 strands or twenty No. 30 strands of copper wire (for purposes of simplicity of illustration, it is noted that FIG. 3 does not show all ten or twenty strands). The strands are wound adjacent each other such that they are in electrical contact with each other and are also laid side by side so as to approximate a ribbon conductor. As can be seen in FIG. 3, the width 122 of the ribbon-like conductor made from the numerous strands of copper wire is such that the numerous strands approximate a ribbon-like conductor. Further, it is important in the winding pattern according to the present invention that the width 122 of the plurality of conductors 124 is approximately equal to the spacing 126 between the wraps of the plurality of conductors 124. This feature of applicant's invention is further emphasized in FIG. 3 by the reference dimension letter d which indicates that the distance along the longitudinal axis of the tapered fiberglass rod 32 is the same for the group of conductors 124 as for the spacing 126 between adjacent groups of conductors 124. In this way it can be appreciated that the plurality of conductors 124 can radiate from both sides, i.e. not only outwardly from the fiberglass rod 32 but also through the fiberglass rod 32 and out the other side. Thus, by way of example, the portion **124*b* of the plurality of conductors 124 that are on the underside of fiberglass rod 32 as illustrated in FIG. 3 may radiate through fiberglass rod 32** in a direction out of the page. They also will radiate in the direction looking into the page.

Figure 4:
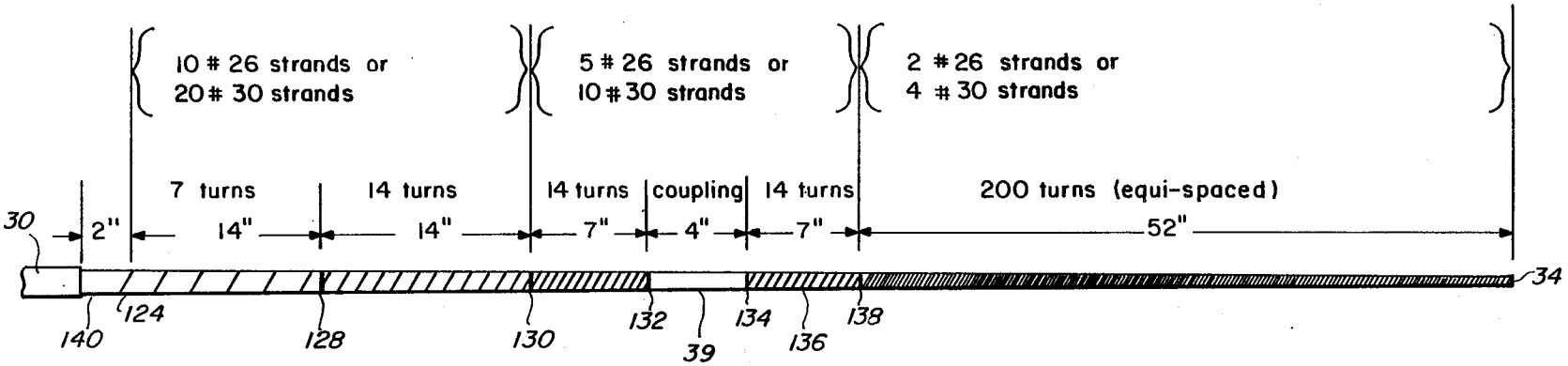
FIG. 4 is a side view of the whip portion of the present invention with the outer fiberglass sheath removed, illustrating the preferred embodiment of the radiating element winding pattern of the present invention with dimensions illustrated by way of example.

In order to accomodate the tapered aspect of the fiberglass rod 32, the pitch, i.e. number of turns per unit length, of the windings of the radiating element 36 is varied along the length of the fiberglass rod 32. More particularly, the pitch of the windings is varied in the manner illustrated in FIG. 4 which illustrates schematically the preferred embodiment of the winding pattern of the present invention. As can be seen in FIG. 4, the winding pattern is initiated with seven turns of either ten No. 26 strands or twenty No. 30 strands of copper wire. This winding pattern extends for approximately fourteen inches at which point, point 128 in FIG. 4, the pitch is increased such that there is one turn per inch of fiberglass rod 32 or fourteen turns in the fourteen inch section of fiberglass rod 32 between points 128 and 130. At transition point 130, either five of the No. 26 strands or ten of the No. 30 strands are cut and terminated. The remaining five No. 26 strands or ten No. 30 strands are wrapped fourteen times around a seven inch length of the fiberglass rod 32 to point 132. Between transition points 132 and 134 the remaining plurality 136 are extended linearly up the fiberglass rod. At transition point 134 on fiberglass rod, the remaining strands 136 are again continued in the wrapping pattern at a pitch rate of fourteen turns per seven inches of length. At transition point 138 on fiberglass rod 32, either three of the five No. 26 strands or six of the ten No. 30 strands are terminated and the remaining two No. 26 strands or four No. 30 strands are wrapped at a pitch rate of two hundred turns per fifty-two inch length of fiberglass rod. This wrapping pattern is continued until the tip 34 of the fiberglass rod 32 is reached.

Finally, following the wrapping of the fiberglass whip 32 with the radiating conductors as described above, a fiberglass jacket 140 (see FIG. 3) is put in place over the radiating elements.

Figure 5:
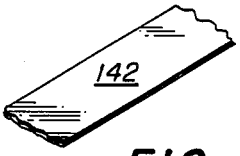
FIG. 5 is an isometric view of a portion of an unwound radiating element of the present invention utilizing the disclosed alternative of a ribbon-like conductor radiating element.

It should be appreciated, that in lieu of using multi-stranded copper wire as the radiating element with the plurality of strands laid side by side so as to approximate a ribbon conductor, it is considered within the scope of the present invention to actually utilize a ribbon-like conductor as is illustrated, in part in FIG. 5. The ribbon conductor 142 would be formed so as to have the same approximate width of the multiwire radiating element conductors 124, 136, etc. illustrated and described with respect to FIGS. 3 and 4.

Obviously many modifications and variations of the present invention are possible in the light of the above teachings. It is therefore to be understood that within the scope of the appended claims the invention may be practiced otherwise than as specifically described.

What is claimed is:

1. In an assembly for securing an HF whip antenna to a mounting surface that is held at ground potential, said assembly including an electrically conductive base spring for permitting said whip antenna to yield to shocks and for providing flexibility in the mounting of said whip antenna, said assembly further including an electrically conductive base support flange mechanically secured to said base spring and for attachment to said mounting surface, the improvement comprising:

said base spring being electrically connected to said base support flange such that the entirety of said base spring is held at ground potential and such that said base support flange is held at ground potential.

2. An electrical connector and mounting assembly for a whip antenna comprising:

a base flange having an upper end, a lower end and an interior passageway;

an RF connector having a metallic housing and an inner conductor, said RF connector being secured to said base flange at said lower end for receiving an RF signal on said inner conductor;

a first nipple secured to said base flange upper end and having an interior passageway;

a base spring assembly for permitting flexibility and shock yielding in the mounting of said whip antenna, said base spring assembly being mechanically secured to and electrically connected to said first nipple and to said base flange and having an interior cavity;

a coaxial cable having an inner conductor electrically connected to said RF connector inner conductor and having an outer conductor electrically connected to said RF connector metallic housing, said coaxial cable extending through said first nipple and through said base spring assembly interior cavity.

3. The electrical connector and mounting assembly of claim 2 wherein:

said base spring assembly has an upper end and a lower end;

said first nipple is connected to said base spring assembly lower end; and wherein said electrical connector and mounting assembly further comprises:

a second nipple electrically and mechanically connected to said base spring assembly upper end.

4. The electrical connector and mounting assembly of claim 3 wherein:

said coaxial cable extends through said second nipple.

5. A whip antenna comprising:

a tapered fiberglass rod having a longitudinal axis and a first end with a first cross section diameter and having a second end with a second cross section diameter, said first cross section diameter being larger than said second cross section diameter;

means for providing an electrical connection at said first end of said tapered fiberglass rod;

a driven antenna radiator comprising a plurality of individual, equal diameter non-braided conductors disposed with respect to each other and parallel to each other such that each individual conductor is in electrical and mechanical contact with each adjacent individual conductor along substantially the entire lengths thereof so as to approximate a ribbon conductor, helically wound around said tapered fiberglass rod so as to create wrapped areas around said tapered fiberglass rod and non-wrapped areas on said tapered fiberglass rod between said wrapped areas, the length of said wrapped areas along said longitudinal axis being approximately equal to the length of said non-wrapped areas along said longitudinal axis, each of said plurality conductors being electrically connected to said means for providing an electrical connection.

6. The whip antenna of claim 5 wherein:

said plurality of individual, equal diameter conductors comprises at least three individual, equal diameter conductors.

7. The whip antenna of claim 5 further comprising:

each of said plurality of individual, equal diameter, non-braided conductors being an electrically continuous conductor throughout the length of said tapered fiberglass rod.

8. A whip antenna comprising:

a tapered fiberglass rod having a longitudinal axis and having a large diameter end and a small diameter end;

means for providing an electrical connection at said large diameter end of said tapered fiberglass rod;

a driven antenna radiator comprising a first plurality of individual conductors each having the same diameter, disposed adjacent each other so as to approximate a ribbon conductor, helically wound around said tapered fiberglass rod adjacent said large diameter end, so as to create first conductor wrapped areas and first conductor non-wrapped areas between said first conductor wrapped areas on said tapered fiberglass rod, the length of said first conductor wrapped areas along said longitudinal axis being approximately equal to the length of said first conductor non-wrapped areas along said longitudinal axis, each of said first plurality of individual conductors being electrically connected to said means for providing an electrical connection;

said driven antenna radiator further comprising a second plurality of individual conductors each having the same diameter disposed adjacent each other so as to approximate a ribbon conductor, electrically connected to said first plurality of individual conductors, helically wound around said tapered fiberglass rod next to said first plurality of individual conductors and closer to said small diameter end than said first plurality of individual conductors, said second plurality of conductors being wrapped so as to create second conductor wrapped areas and second conductor non-wrapped areas between said second conductor wrapped areas, the length of said second conductor wrapped areas along said longitudinal axis being approximately equal to the length of said second conductor non-wrapped areas along said longitudinal axis, said second plurality of individual conductors being connected in series with said first plurality of individual conductors and thereby being electrically connected to said means for providing an electrical connection, said length of said first conductor wrapped areas along said longitudinal axis being greater than said length of said second conductor wrapped areas along said longitudinal axis.

9. The whip antenna of claim 8 wherein:

the number of conductors in said first plurality of conductors is equal to the number of conductors in said second plurality of conductors; and the number of turns of said second plurality of conductors around a unit of length of said tapered fiberglass rod is greater than the number of turns of said first plurality of conductors around an equal unit of length of said tapered fiberglass rod.

10. The whip antenna of claim 8 wherein the number of conductors in said second plurality of conductors is less than the number of conductors in said first plurality of conductors.

11. The whip antenna of claim 10 wherein:

the number of turns of said second plurality of conductors around a unit length of said tapered fiberglass rod is greater than the number of turns of said first plurality of conductors around an equal unit of length of said tapered fiberglass rod.

12. A whip antenna element comprising:

a tapered fiberglass rod having a first end and a second end;

means for providing an electrical connection at said first end of said tapered fiberglass rod;

a driven antenna radiator comprising a plurality of individual conductors disposed adjacent each other and in electrical contact with each other and positioned so as to approximate a ribbon conductor, helically wound around said tapered fiberglass rod, each of said plurality of individual conductors being electrically connected to said means for providing an electrical connection.

13. The whip antenna element of claim 12 wherein:

said plurality of individual conductors are wrapped around said tapered fiberglass rod so as to create wrapped and non-wrapped areas between said wrapped areas on said tapered fiberglass rod, the width of said wrapped areas being substantially equal to the width of said non-wrapped areas.

14. In the combination of a whip antenna and mounting assembly, the improvement comprising:

a base flange having an upper end, a lower end and an interior passageway;

an RF feed conductor extending through said base flange interior passageway;

a first nipple secured to said base flange upper end and having an interior passageway, said RF feed conductor extending through said first nipple interior passageway;

a base spring assembly for permitting flexibility and shock yielding in the mounting of said whip antenna, said base spring assembly being mechanically secured to and electrically connected to said nipple and having an interior cavity, said RF feed conductor extending through said interior cavity;

a second nipple mechanically and electrically connected to said base spring assembly, and having an interior passageway, said RF feed conductor extending through said second nipple interior passageway;

a sleeve having an interior passageway mechanically and electrically connected to said second nipple, said RF feed conductor extending into said sleeve interior passageway;

a tapered fiberglass rod secured to said sleeve;

a plurality of individual non-braided conductors disposed adjacent each other, parallel to each other and such that each individual conductor is in electrical and mechanical contact with each adjacent individual conductor along the entire lengths thereof, electrically connected to said RF feed conductor, and positioned so as to approximate a ribbon conductor, helically wound around said tapered fiberglass rod.

15. A whip antenna element comprising:

a tapered fiberglass rod having a longitudinal axis and having a first end and a second end;

means for providing an electrical connection at said tapered fiberglass rod first end;

a driven antenna radiator comprising a flat ribbon-shaped electrical conductor, helically wound around said tapered fiberglass rod, said flat, ribbon-shaped conductor being wound around said tapered fiberglass rod so as to form wrapped and non-wrapped areas on said tapered, fiberglass rod, the length of said wrapped areas along said longitudinal axis being approximately equal to the length of said non-wrapped areas along said longitudinal axis, said flat, ribbon-shaped conductor being electrically connected to said means for providing an electrical connection.

16. The whip antenna element of claim 15 wherein:

said flat ribbon-shaped electrical conductor is electrically continuous along substantially the entire length of said tapered fiberglass rod.

17. An electrical connector and mounting assembly for a whip antenna comprising:

a base flange having an upper end, a lower end and an interior passageway;

an RF connector having a metallic housing and an inner conductor, said RF connector being secured to said base flange at said lower end for receiving an RF signal on said inner conductor;

a first nipple secured to said base flange upper end and having an interior passageway;

a base spring assembly having an upper end and a lower end for permitting flexibility and shock yielding in the mounting of said whip antenna, said base spring assembly being mechanically secured to and electrically connected to said first nipple and to said base flange and having an interior cavity, said first nipple being connected to said base spring assembly lower end;

a second nipple electrically and mechanically connected to said base spring assembly upper end;

a coaxial cable having an inner conductor electrically connected to said RF connector inner conductor and having an outer conductor electrically connected to said RF connector metallic housing, said coaxial cable extending through said first nipple and through said base spring assembly interior cavity and said coaxial cable extending through said second nipple;

said second nipple having a first end and a second end and said second nipple first end being connected to said base spring assembly upper end; and a sleeve mechanically and electrically connected to said second nipple second end, said coaxial cable extending into said sleeve.

18. The electrical connector and mounting assembly of claim 17 further comprising:

a fiberglass rod for supporting said antenna at least a portion of which is contained within said sleeve.

19. The electrical connector and mounting assembly of claim 18 wherein:

said fiberglass rod has a surface and a center and includes a core extending along a first portion of the length thereof and also extending at a second portion thereof from the surface of said fiberglass rod to approximately the center thereof; and wherein said electrical connector and mounting assembly further comprises:

an electrical conductor positioned within said core and electrically connected to said center conductor of said coaxial cable.

20. The electrical connector and mounting assembly of claim 19 further comprising:

a retaining key positioned within said core and substantially filling said core for retaining said electrical conductor within said core.

21. The electrical connector and mounting assembly of claim 20 wherein:

said base flange, said first nipple, said second nipple, said base spring assembly and said sleeve each comprise electrically conductive material.

22. The electrical connector and mounting assembly of claim 21 wherein:

said electrically conductive mateiral comprises stainless steel.

23. The electrical connector and mounting assembly of claim 22 wherein:

said interior passageway in said base flange is filled with potting compound.

* * * * *